US008937442B1

(12) United States Patent
Qi

(10) Patent No.: US 8,937,442 B1
(45) Date of Patent: Jan. 20, 2015

(54) LIGHT EMITTING DIODE DRIVING CIRCUIT STRUCTURE

(71) Applicant: Asia Vital Components Co., Ltd., Sinjhuang District, New Taipei (TW)

(72) Inventor: Zheng-Tuan Qi, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 0 days.

(21) Appl. No.: 13/953,722

(22) Filed: Jul. 29, 2013

(51) Int. Cl.
*G05F 1/00* (2006.01)

(52) U.S. Cl.
USPC ..... 315/291; 315/307; 315/119; 315/185 S; 315/312

(58) Field of Classification Search
USPC ..... 315/119, 200 R, 207, 224, 185 S, 291, 315/307–325
See application file for complete search history.

(56) References Cited

U.S. PATENT DOCUMENTS

2008/0258631 A1* 10/2008 Wu et al. ..... 315/129
2013/0162156 A1* 6/2013 Sutardja et al. ..... 315/201

* cited by examiner

*Primary Examiner* — Tuyet Thi Vo

(57) ABSTRACT

A light emitting diode (LED) driving circuit structure includes a surge absorber unit, a voltage suppression unit connected to the surge absorber unit, a rectifier unit electrically connected to the voltage suppression unit, a control chip connected to a fourth junction of the rectifier unit, and an impedance unit connected to the control chip. The LED driving circuit structure is installed on an LED light circuit board having a plurality of LEDs mounted thereon. According to the sinusoidal wave form of the alternating current (AC) supplied to the LEDs as well as the number and layout of the LEDs on the LED light circuit board, the LED driving circuit structure controls the current flowing through the LEDs to vary with changes of supply voltage, so as to enable effectively increased power factor and reduced harmonics, as well as effectively lowered manufacturing and material costs.

10 Claims, 3 Drawing Sheets

LIGHT EMITTING DIODE DRIVING CIRCUIT STRUCTURE

FIELD OF THE INVENTION

The present invention relates to a light emitting diode (LED) driving circuit structure, and more particularly, to an LED driving circuit structure that uses light emitting diodes as light sources.

BACKGROUND OF THE INVENTION

People's demands for energy continuously increase with the progress in various technological fields. To avoid shortage or even depletion of energy resources, endeavors have been made to discover new energy sources. On the other hand, effective means have also been developed to minimize the power consumption of existing electric and electronic devices.

Lighting fixtures account for a very large part in all kinds of power-consuming devices. Presently, the bases for general lamps are mainly divided into two types, namely, conventional and electronic lamp bases. The conventional and the electronic lamp base all are equipped with a starter, but have a conventional and an electronic ballast, respectively. The conventional ballast and the electronic ballast are different in their wiring configuration, fundamental characteristics, use manners and power consumption. The biggest difference between the conventional and the electronic ballast is that the conventional ballast uses a low frequency of 60 Hz, while the electronic ballast uses a high frequency ranged between 30,000 and 50,000 Hz.

Since the lighting fixtures account for a very large part in the power-consuming devices, improvements of the power consumption efficiency of lighting fixtures and development of creative use manners thereof have become new and important issues. Among others, the use of LEDs to replace the conventional illumination light sources has become a frequently adopted technical means for improvement of various kinds of lighting fixtures. In recent years, the LED-related technique develops quickly to largely widen the applications of LEDs. There are more and more daily necessaries with LEDs. The LED illuminates light using high current with low voltage, and has the advantages of long service life, low power consumption and low heat production. With these advantages, LEDs are environmentally friendly and attract many manufacturers to the research and development of LED tube lights.

Driving circuits for LED tube lights are generally divided into three types according to their technical features. In the first type of driving circuit for LED tube light, two circuit boards are included, one of which is a power driving circuit board while the other one is an LED circuit board. The power driving circuit board and the LED circuit board are electrically connected to each other via conductors or connection terminals and all are mounted in the tube light, so that power can be effectively supplied from the power driving circuit board to the LED circuit board to produce light sources. In the second type of driving circuit for LED tube light, three circuit boards are included in the LED tube light. Two of the circuit boards are power driving circuit boards while the third one is an LED circuit board. The two power driving circuit boards are separately arranged at two opposite ends of the tube light, and the LED circuit board is arranged in the tube light at a middle section thereof and electrically connected via conductors or connection terminals to the power driving circuit boards located at two opposite ends of the tube light, such that power can be effectively supplied from the power driving circuit boards to the LED circuit board to produce light sources. In the third type of driving circuit for LED tube light, only one LED circuit board is included in the LED tube light. The LED circuit board is connected via conductors to two pinned bases mounted to two opposite ends of the tube light, and a power driving circuit is arranged outside the tube light or in a corresponding lamp base.

In either one of the above-mentioned three types of driving circuits for LED tube light, complicated wiring is required to achieve electrical connection between the LED circuit board and the power driving circuit boards or the externally arranged power driving circuit. Since the tube light has only very limited internal space, complicated working procedures are needed to mount the LED circuit board and the somewhat bulky power driving circuit boards in the small internal space of the LED tube light, which inevitably largely increases the manufacturing and material costs of the LED tube light.

SUMMARY OF THE INVENTION

A primary object of the present invention is to provide an LED driving circuit structure, with which a driving power supply can be directly provided on an LED light circuit board to enable effectively reduced manufacturing and material costs.

Another object of the present invention is to provide an LED driving circuit structure that solves the problems of having the conventional large-volume power driving circuit boards and inconvenience in assembling the LED tube light.

A further object of the present invention is to provide an LED driving circuit structure, which uses the sinusoidal wave form of the supplied alternating current and the layout of LEDs on an LED light circuit board as a basis in controlling the current flowing through LEDs to vary with changes of supply voltage, so as to enable effectively increased power factor and reduced harmonics.

To achieve the above and other objects, the LED driving circuit structure according to the present invention includes a surge absorber unit, a voltage suppression unit, a rectifier unit, a control chip and an impedance unit. The surge absorber unit has a first surge absorber pin and a second surge absorber pin. The voltage suppression unit has a first voltage suppression pin and a second voltage suppression pin; and the first and the second voltage suppression pin are connected to the first and the second surge absorber pin, respectively. The rectifier unit has a first, a second, a third and a fourth junction; and the first and the third junction are connected to the first and the second voltage suppression pin, respectively. The control chip generates at least one control signal, and is connected to the fourth junction of the rectifier unit. The impedance unit has a plurality of resistor elements and is connected to the control chip. The LED driving circuit structure is directly installed on an LED light circuit board and uses the sinusoidal wave form of the supplied alternating current as well as the layout and number of the LEDs mounted on the LED light circuit board as a basis in controlling the current flowing through the LEDs to vary with changes of supply voltage, so as to enable effectively increased power factor and reduced harmonics, and effectively lowered manufacturing and material costs.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
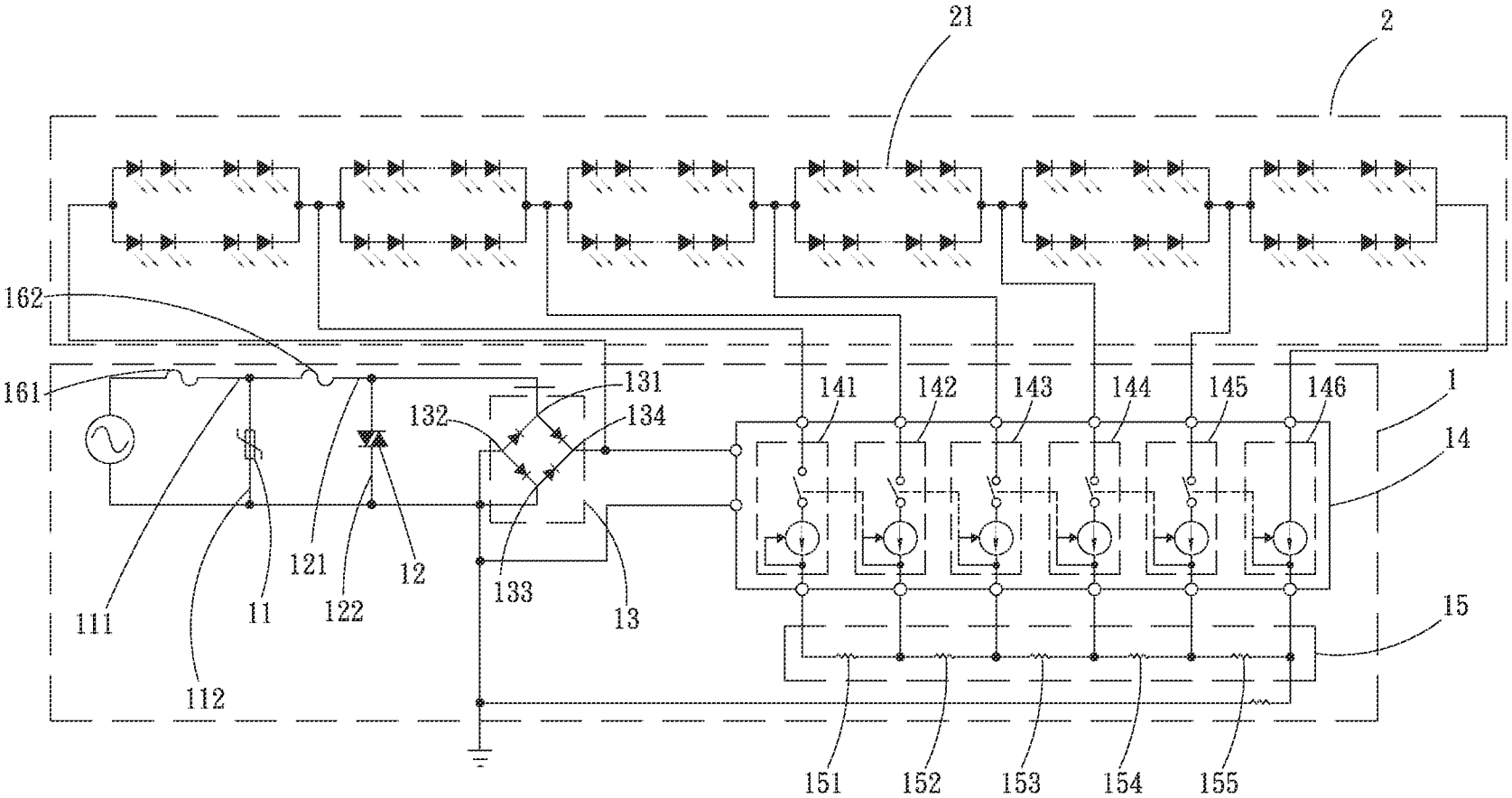
FIG. 1 is a circuit diagram of a light emitting diode (LED) driving circuit structure according to a first preferred embodiment of the present invention.

The present invention will now be described with some preferred embodiments thereof and with reference to the accompanying drawings. For the purpose of easy to understand, elements that are the same in the preferred embodiments are denoted by the same reference numerals.

Figure 2:
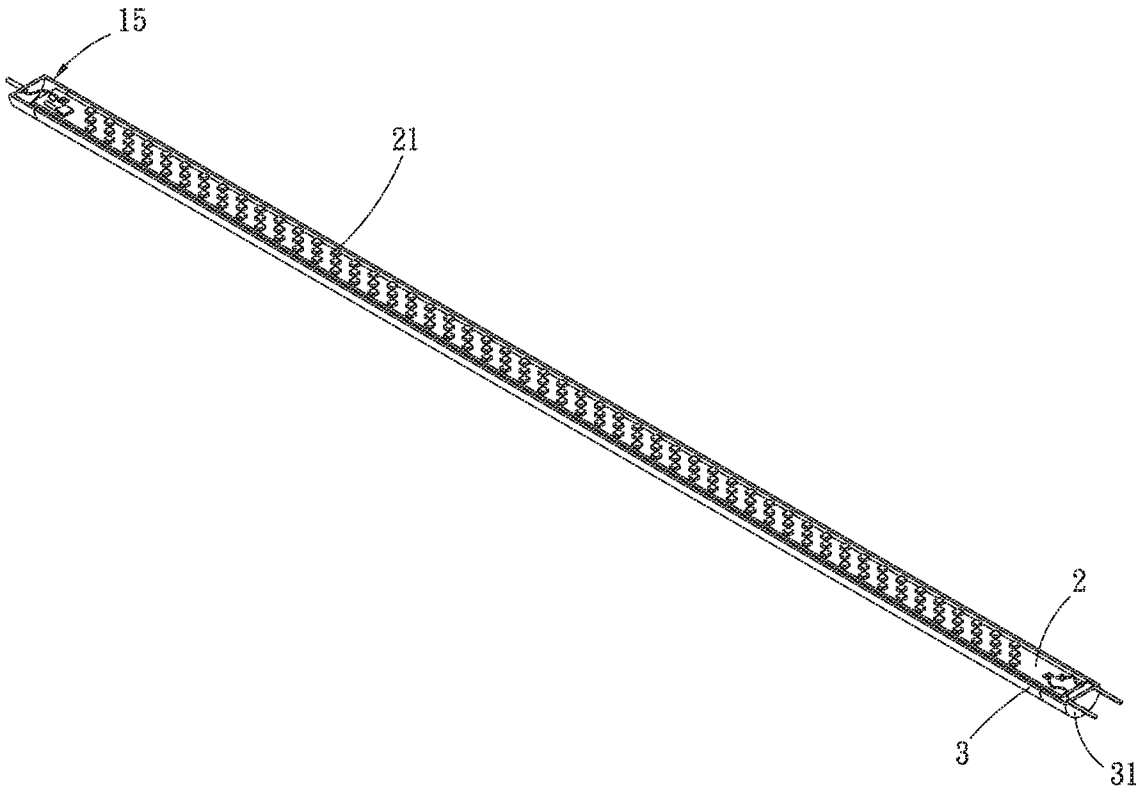
FIG. 2 is a perspective view of an example LED light circuit board, on which the LED driving circuit structure of the present invention is installed.

Please refer to FIG. 1 that is a circuit diagram of an LED driving circuit structure 1 according to a first preferred embodiment of the present invention, and to FIG. 2 that is a perspective view of an example LED light circuit board 2, on which the LED driving circuit structure 1 of the present invention is installed. As shown, the LED driving circuit structure 1 is correspondingly installed on the LED light circuit board 2, which has a plurality of LEDs 21 mounted thereon and is designed for installing in a tube light 3. The tube light 3 has two opposite ends, to each of which a pinned base 31 is fitted. The LED driving circuit structure 1 includes a surge absorber unit 11, a voltage suppression unit 12, a rectifier unit 13, a control chip 14, and an impedance unit 15.

In the first preferred embodiment, the surge absorber unit 11 is a varistor. The surge absorber unit 11 includes a first surge absorber pin 111 and a second surge absorber pin 112, which are connected to power input units, i.e. the pinned bases 31. When an instant surge voltage occurs, the surge absorber unit 11 would have a lowered impedance to cause a short circuit. In the first preferred embodiment, the voltage suppression unit 12 is a voltage suppressor, and includes a first voltage suppression pin 121 and a second voltage suppression pin 122, which are connected to the first and the second surge absorber pin 111, 112, respectively. When a supply voltage is increased to a threshold value thereof, the voltage suppressor unit 12 would have a rapidly lowered resistance value to induce current to flow through the voltage suppression unit 12 without successfully passing through the LED driving circuit structure 1, so that a short circuit occurs when there is an overshoot voltage, and the LED driving circuit structure 1 is protected against overvoltage via the surge absorber unit 11 and the voltage suppression unit 12. Moreover, for further circuit protection effect, the LED driving circuit structure 1 includes a first fuse 161 arranged between the power input unit and the first surge absorber pin 111, and a second fuse 162 arranged between the first surge absorber pin 111 and the first voltage suppression pin 121.

In the illustrated first preferred embodiment, the rectifier unit 13 is a bridge rectifier, and includes a first junction 131, a second junction 132, a third junction 133, and a fourth junction 134. The first junction 131 is connected to the first voltage suppression pin 121, the third junction 133 is connected to the second voltage suppression pin 122, and the fourth junction 134 is connected to the control chip 14. The control chip 14 generates at least one control signal, and includes at least one driving switch. In the illustrated first preferred embodiment, the control chip 14 is divided into a first, a second, a third, a fourth, a fifth and a sixth driving switch 141-146; and is described as having fourteen (14) pins. However, it is understood the first preferred embodiment is only illustrative without limiting the present invention thereto in any way. In practice of the present invention, a control chip with more pins may be used according to actual functional requirements. For example, a 16-pin control chip, a 18-pin control chip, or a control chip with more than 18 pins can be used.

The impedance unit 15 has a plurality of resistor elements and is connected to the control chip 14. In the illustrated first preferred embodiment, the impedance unit 15 includes a first, a second, a third, a fourth and a fifth resistor element 151-155. The first resistor element 151 is correspondingly arranged between the first and the second driving switch 141, 142; the second resistor element 152 between the second and the third driving switch 142, 143; the third resistor element 153 between the third and the fourth driving switch 143, 144; the fourth resistor element 154 between the fourth and the fifth driving switch 144, 145; and the fifth resistor element 155 between the fifth and the sixth driving switch 145, 146.

The LED driving circuit structure 1 is installed on the LED light circuit board 2 with the control chip 14 electrically connected to all the LEDs 21 mounted on the LED light circuit board 2. In the illustrated first preferred embodiment, the LEDs 21 are first connected in series, and the serially connected LEDs 21 are then connected in parallel to form branches. The number of serially connected LEDs 21 and the number of the branches are determined according to the fact the alternating current (AC) sinusoidal wave form can be generated by different voltages. Therefore, at different voltage phase changes, the current flowing through the LEDs 21 in each branch varies with changes of the AC voltage. Further, the current flowing through the LEDs 21 in each of the branches can be regulated by the resistor elements of the impedance unit 15. Meanwhile, the control signals generated by the control chip 14 automatically control the first to the sixth driving switch 141-146 for them to control the LEDs 21 in each of the branches, and limit the current flowing through each branch of LEDs to a level defined for the LEDs 21. With these arrangements, the LED driving circuit structure 1 can be directly installed on the LED light circuit board 2 to eliminate the problems of having the conventional large-volume power driving circuit boards and causing inconvenience in assembling the LED tube light, and further enables effectively reduced manufacturing and material costs, increased power factor, and reduced harmonics.

Figure 3:
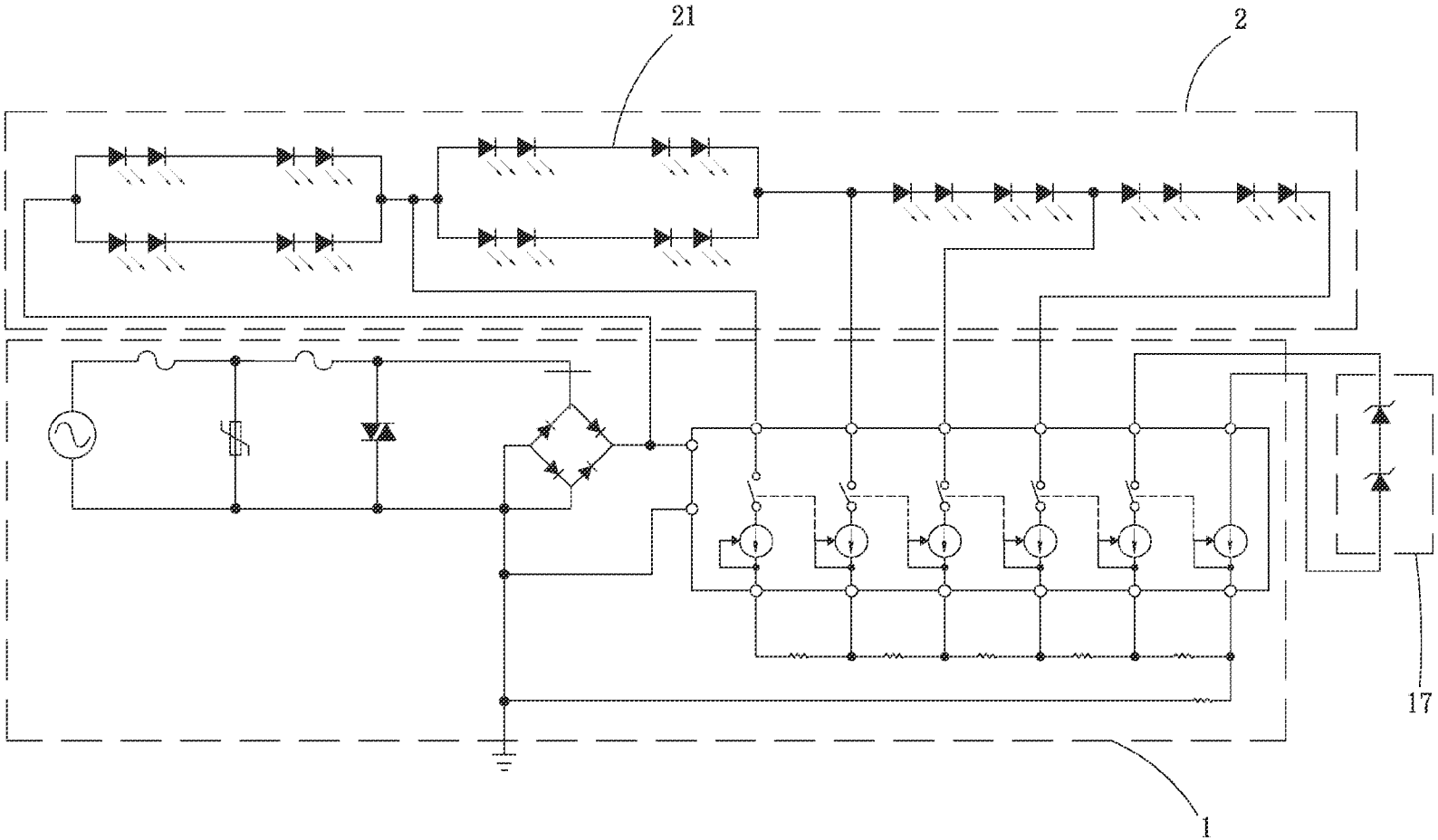
FIG. 3 is a circuit diagram of a light emitting diode (LED) driving circuit structure according to a second preferred embodiment of the present invention.

FIG. 3 is a circuit diagram of an LED driving circuit structure 1 according to a second preferred embodiment of the present invention. As shown, the second preferred embodiment is generally structurally similar to the first preferred embodiment, except for a voltage regulator unit 17, which is further included in the LED driving circuit structure 1 and includes two serially connected Zener diodes. The voltage regulator unit 17 functions to stabilize the supply voltage when the current flowing through the LEDs 21 in each of the branches varies with changes of AC voltage, and accordingly effectively maintains the current flowing through the branches within the level defined for the LEDs 21. In the second preferred embodiment, the LEDs 21 are first connected in series, and a part of the serially connected LEDs 21 is then connected in parallel to form branches. The number of serially connected LEDs 21 and the number of the branches are determined according to the fact the alternating current (AC) sinusoidal wave form can be generated by different voltages. However, it is understood the above-mentioned LED arrangement is only illustrative and not intended to limit the present invention in any way. In practice of the present invention, the arrangement of LEDs 21 can be changed according to actual functional requirements, so as to limit the current flowing through each of the branches to a level defined for the LEDs 21. With these arrangements, the LED driving circuit structure 1 can be directly installed on the LED light circuit board 2 to eliminate the problems of having the conventional large-volume power driving circuit boards and inconvenience in assembling the LED tube light, and enables effectively reduced manufacturing and material costs, increased power factor, and reduced harmonics.

In conclusion, the LED driving circuit structure according to the present invention has the following advantages: (1) eliminating the problems of having conventional large-volume power driving circuit boards and inconvenience in assembling the LED tube light; (2) enabling effectively reduced manufacturing and material costs; and (3) enabling effectively increased power factor and reduced harmonics.

The present invention has been described with some preferred embodiments thereof and it is understood that many changes and modifications in the described embodiments can be carried out without departing from the scope and the spirit of the invention that is intended to be limited only by the appended claims.

What is claimed is:

1. An LED driving circuit structure, comprising:

a surge absorber unit having a first surge absorber pin and a second surge absorber pin;

a voltage suppression unit having a first voltage suppression pin and a second voltage suppression pin; and the first and the second voltage suppression pin being connected to the first and the second surge absorber pin, respectively;

a rectifier unit having a first, a second, a third and a fourth junction; and the first and the third junction being connected to the first and the second voltage suppression pin, respectively;

a control chip for generating at least one control signal, and being connected to the fourth junction of the rectifier unit; and an impedance unit having a plurality of resistor elements and being connected to the control chip.

2. The LED driving circuit structure as claimed in claim 1, wherein the control chip has at least one driving switch.

3. The LED driving circuit structure as claimed in claim 1, wherein the surge absorber unit is a varistor.

4. The LED driving circuit structure as claimed in claim 1, wherein the voltage suppression unit is a voltage suppressor.

5. The LED driving circuit structure as claimed in claim 1, wherein the rectifier unit is a bridge rectifier.

6. The LED driving circuit structure as claimed in claim 1, further comprising a first and a second fuse.

7. The LED driving circuit structure as claimed in claim 1, further comprising a voltage regulator unit; the voltage regulator unit connected to the control chip.

8. The LED driving circuit structure as claimed in claim 7, wherein the voltage regulator unit includes two Zener diodes connected in series.

9. The LED driving circuit structure as claimed in claim 1, wherein the LED driving circuit structure is installed on an LED light circuit board, which has a plurality of LEDs mounted thereon and connected to the control chip and the fourth junction of the rectifier unit; the LED light circuit board being installed in a tube light; and the tube light having two opposite ends, to each of which a pinned base is fitted for electrically connecting to the LED light circuit board.

10. The LED driving circuit structure as claimed in claim 9, wherein the first and the second surge absorber pin are further connected to the pinned bases.

* * * * *